US012350733B2

(12) United States Patent
Nakano

(10) Patent No.: US 12,350,733 B2
(45) Date of Patent: Jul. 8, 2025

(54) MEASURING DEVICE

(71) Applicant: SINTOKOGIO, LTD., Nagoya (JP)

(72) Inventor: Yutaka Nakano, Nagoya (JP)

(73) Assignee: SINTOKOGIO, LTD., Nagoya (JP)

( * ) Notice: Subject to any disclaimer, the term of this patent is extended or adjusted under 35 U.S.C. 154(b) by 0 days.

(21) Appl. No.: 18/678,155

(22) Filed: May 30, 2024

(65) Prior Publication Data

US 2024/0399447 A1 Dec. 5, 2024

(30) Foreign Application Priority Data

Jun. 1, 2023 (JP) ..... 2023-091091
May 22, 2024 (JP) ..... 2024-083310

(51) Int. Cl.
*B22C 23/00* (2006.01)
*B22C 19/04* (2006.01)

(52) U.S. Cl.
CPC ..... *B22C 23/00* (2013.01); *B22C 19/04* (2013.01)

(58) Field of Classification Search
CPC ..... B22C 23/00; B22C 19/04
See application file for complete search history.

(56) References Cited

U.S. PATENT DOCUMENTS

2023/0003588 A1 1/2023 Kishi et al.

FOREIGN PATENT DOCUMENTS

JP 2023-006773 A 1/2023

*Primary Examiner* — Kevin P Kerns
*Assistant Examiner* — Steven S Ha
(74) *Attorney, Agent, or Firm* — Faegre Drinker Biddle & Reath LLP

(57) ABSTRACT

A measuring device according to one aspect is used to measure a loss on ignition of foundry sand. This measuring device includes a container configured to accommodate foundry sand, the container having a discharge port for discharging the foundry sand to a discharge position, a heating device configured to heat the foundry sand in the container, a conveying device configured to convey the foundry sand discharged from the discharge port from the discharge position to a measurement position, a balance configured to measure the weight of the foundry sand disposed at the measurement position, and a furnace configured to heat the foundry sand.

11 Claims, 12 Drawing Sheets

MEASURING DEVICE

CROSS-REFERENCE TO RELATED APPLICATIONS

This application is based on and claims the benefit of priority from Japanese Patent Application No. 2023-091091 filed on Jun. 1, 2023 and Japanese Patent Application No. 2024-083310 filed on May 22, 2024, the entire contents of which are incorporated herein by references.

TECHNICAL FIELD

The present disclosure relates to a measuring device that measures a loss on ignition of foundry sand.

BACKGROUND

Sand molds obtained by molding foundry sand have been widely used as molds for casting. As a type of sand mold, a self-hardening mold that cures a mold by a chemical reaction of a binder added to foundry sand is known. In this type of self-hardening mold, an inorganic material such as water glass and cement, or an organic material such as a furan resin and an alkali phenol resin is used as a binder.

In general, the mold after having been used for casting is crushed to recover foundry sand. The recovered foundry sand is recycled as foundry sand for mold manufacturing by a recycling process. Since the quality of the recycled foundry sand affects the accuracy of casting, the quality of the foundry sand is controlled in foundry mills. The quality of the recycled foundry sand may be evaluated by a loss on ignition (LOI). The LOI is acquired from a weight difference of the foundry sand before and after a calcination step of vaporizing the binder. Since the LOI of the foundry sand corresponds to the amount of the binder vaporized from the foundry sand, the quality of the foundry sand can be evaluated from the measured LOI.

As a device for measuring the LOI of the foundry sand, a device described in Japanese Unexamined Patent Publication No. 2023-6773 is known. The device described in Japanese Unexamined Patent Publication No. 2023-6773 includes a support which supports a measurement target object, a furnace which heats the measurement target object, an elevating mechanism which moves the furnace, the electronic balance moving the furnace so that the measurement target object which is supported by the support is housed in the furnace.

SUMMARY

In order to evaluate the quality of the foundry sand, it is important to measure the LOI after sufficiently removing moisture of the foundry sand. When the moisture remains in the foundry sand, the LOI to be measured changes, so that the amount of the binder in the foundry sand cannot be accurately measured, and it is difficult to accurately evaluate the quality of the foundry sand.

Therefore, an object of the present disclosure is to improve the accuracy of a quality evaluation of foundry sand.

A measuring device according to one aspect is used to measure a loss on ignition of foundry sand. This measuring device includes: a container configured to accommodate foundry sand, the container having a discharge port for discharging the foundry sand to a discharge position; a heating device configured to heat the foundry sand in the container; a conveying device configured to convey the foundry sand discharged from the discharge port from the discharge position to a measurement position; a balance configured to measure the weight of the foundry sand disposed at the measurement position; and a furnace configured to heat the foundry sand.

According to the present disclosure, the accuracy of the quality evaluation of the foundry sand can be improved.

DETAILED DESCRIPTION

Figure 1:
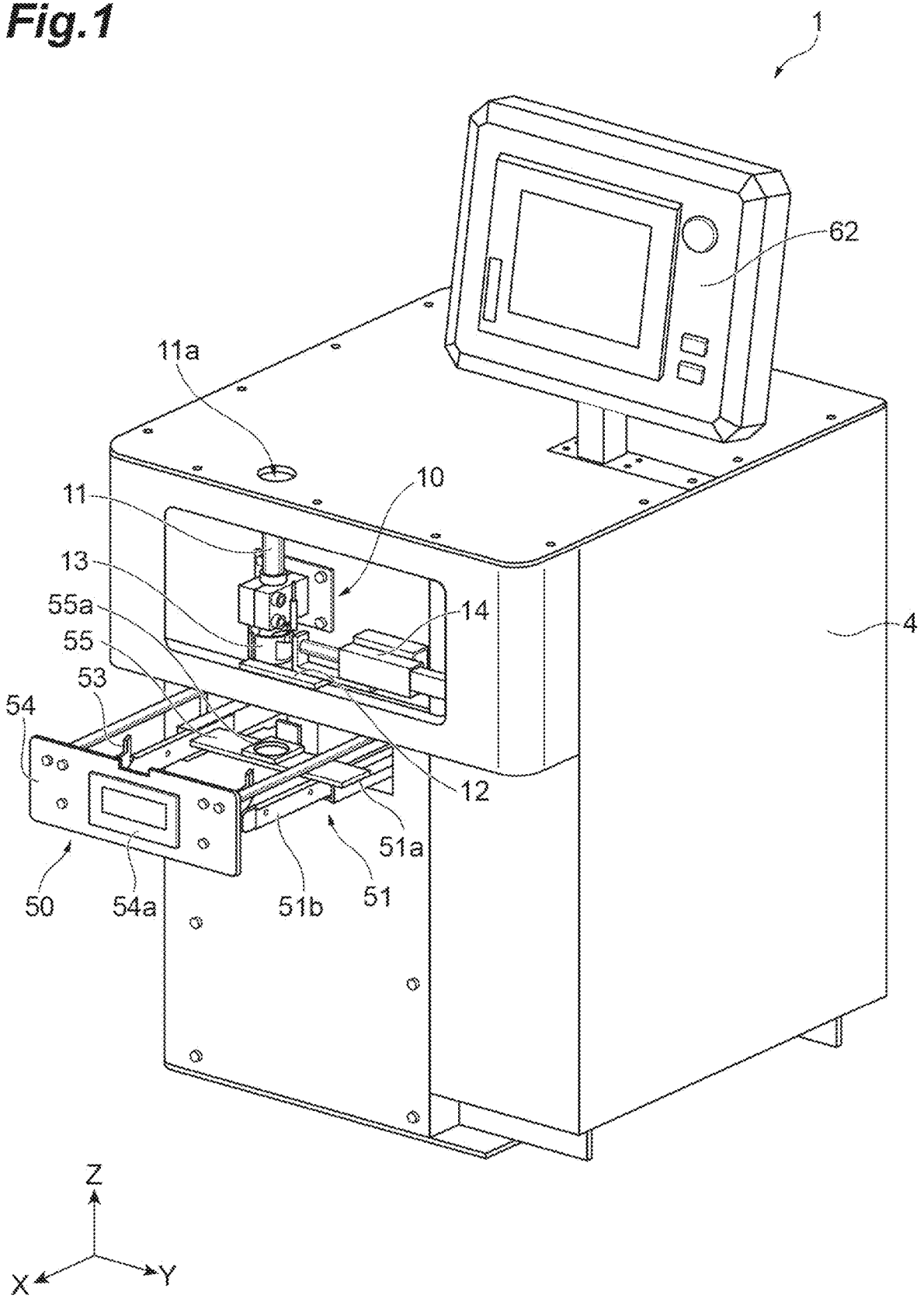
FIG. 1 is a perspective view illustrating an appearance of a measuring device according to an embodiment.

Hereinafter, embodiments of the present disclosure will be described in detail with reference to the drawings. In the description of the drawings, the same elements are denoted by the same reference signs, and redundant description is omitted. The drawings are sometimes partially simplified or exaggerated for easy understanding, and dimensional ratios, angles, and the like are not limited to those described in the drawings.

Figure 2:
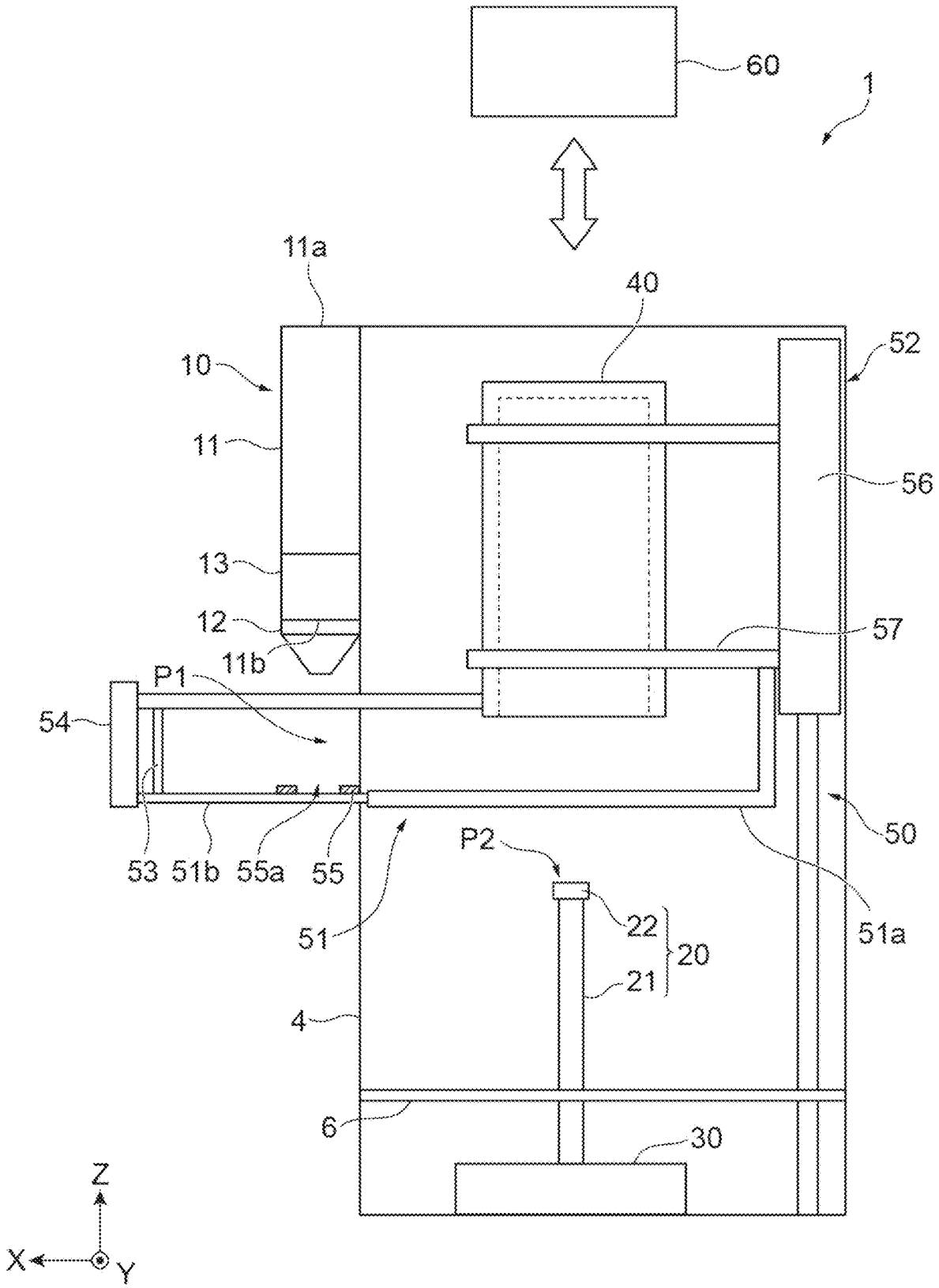
FIG. 2 is a diagram schematically illustrating an internal structure of the measuring device.

FIG. 1 is a perspective view illustrating an appearance of a measuring device 1 according to an embodiment. FIG. 2 is a diagram schematically illustrating an internal configuration of the measuring device 1. In the following description, three axial directions orthogonal to each other are described as an "X direction", a "Y direction", and a "Z direction", respectively. The X direction and the Y direction are horizontal directions perpendicular to each other, and the Z direction is a vertical direction. In the following description, one side in the X direction may be referred to as a "front side", and the other side in the X direction may be referred to as a "back side".

The measuring device 1 is a device configured to measure a loss on ignition (LOI) of foundry sand 2. The foundry sand 2 is a raw material of a self-hardening mold and contains a binder that imparts strength to the mold. The binder is, for example, an organic resin such as a furan resin and an alkali phenol resin, and the mold is cured as time passes. Since the quality of the foundry sand affects the accuracy of casting, a part of the foundry sand 2 is collected before mold manufacturing, and the amount of the binder contained in the foundry sand 2 is measured. The amount of the binder is measured by a LOI test in which the LOI of the foundry sand 2 is measured.

The LOI is obtained from a weight difference of the foundry sand 2 before and after calcination. Since the LOI of the foundry sand 2 corresponds to the amount of the binder vaporized from the foundry sand 2, the quality of the foundry sand 2 can be evaluated from the measured LOI. If the foundry sand 2 to be subjected to the LOI test contains moisture, the amount of vaporized moisture is reflected in the LOI test, and thus, the amount of the vaporized binder cannot be accurately measured. The measuring device 1 has a function of removing moisture from the foundry sand 2 such that the quality of the foundry sand 2 can be accurately evaluated.

The measuring device 1 according to the embodiment will be described with reference to FIGS. 1 and 2. As illustrated in FIG. 2, the measuring device 1 includes a supply device 10, a support 20, a balance 30, a furnace 40, and a conveying device 50. The support 20, the balance 30, the furnace 40, and the conveying device 50 are accommodated in a housing 4 of the measuring device 1.

The supply device 10 is a device that supplies the foundry sand 2 to be subjected to the LOI test, and is disposed outside the housing 4. As illustrated in FIGS. 1 and 2, the supply device 10 includes a container 11, a shutter 12, and a heating device 13. The container 11 is a metallic tubular body having a cylindrical shape, and accommodates the foundry sand 2 to be subjected to the LOI test. The container 11 extends in the Z direction and is fixed to the housing 4 with a metal fitting. Note that a cross-sectional shape of the container 11 is not limited to a circular shape, and may be an elliptical shape or a polygonal shape.

The container 11 has a supply port 11*a* and a discharge port 11*b* which communicate with an internal space of the container 11. As illustrated in FIG. 1, the supply port 11*a* is formed at an upper end of the container 11 and is open on an upper surface of the housing 4. The foundry sand 2 supplied from the supply port 11*a* is stored in the container 11. The discharge port 11*b* is formed at a lower end of the container 11.

Figure 3:
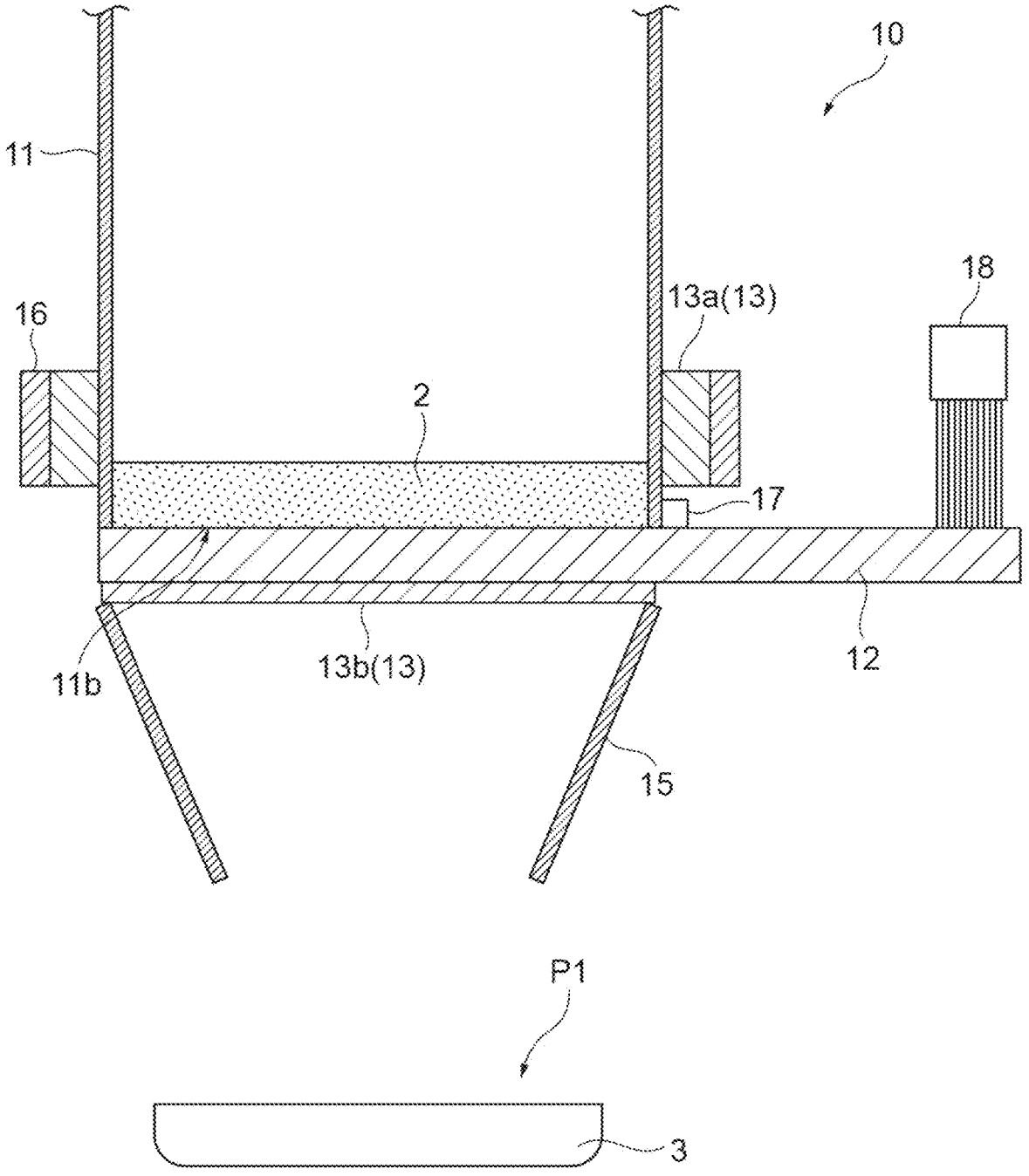
FIG. 3 is a cross-sectional view of the vicinity of a discharge port of a container.

FIG. 3 is a cross-sectional view illustrating the vicinity of the discharge port 11*b* of the container 11. As illustrated in FIG. 3, the shutter 12 is provided in the vicinity of the discharge port 11*b* of the container 11. The shutter 12 is, for example, a metal plate, and is movable between a closed position where the discharge port 11*b* is closed and an open position where the discharge port 11*b* is opened. For example, FIG. 4A illustrates the shutter 12 disposed at the closed position and FIG. 4B illustrates the shutter 12 disposed at the open position.

Figure 4A:
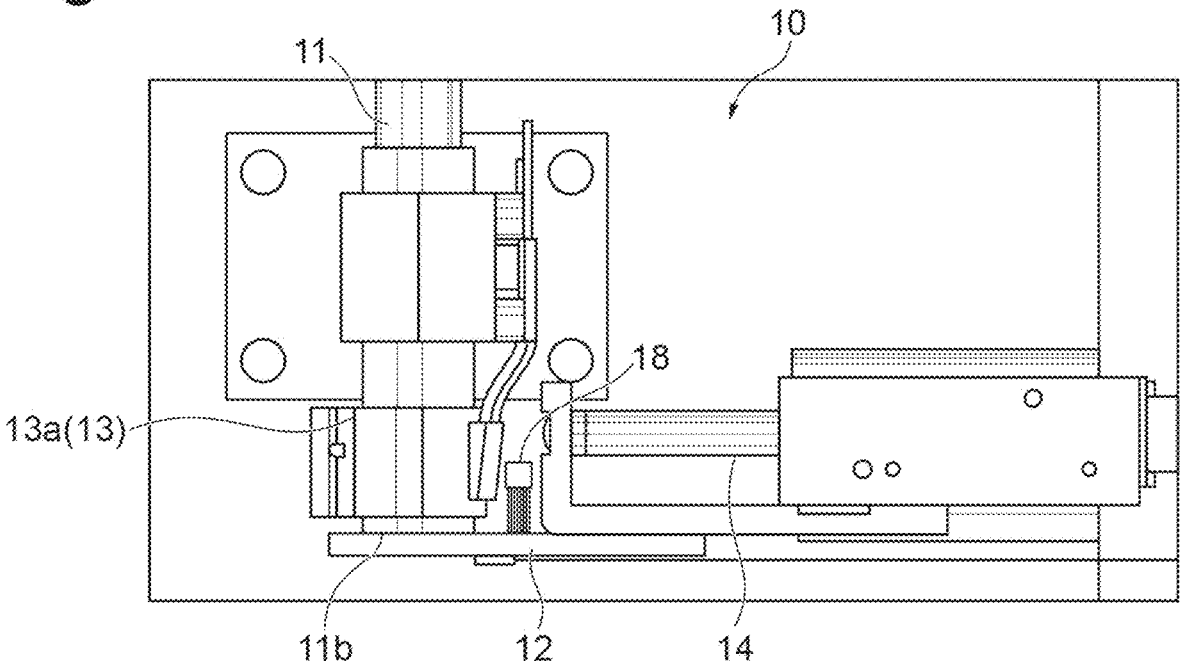
FIGS. 4A and 4B are diagrams illustrating an operation of a shutter.
Figure 4B:
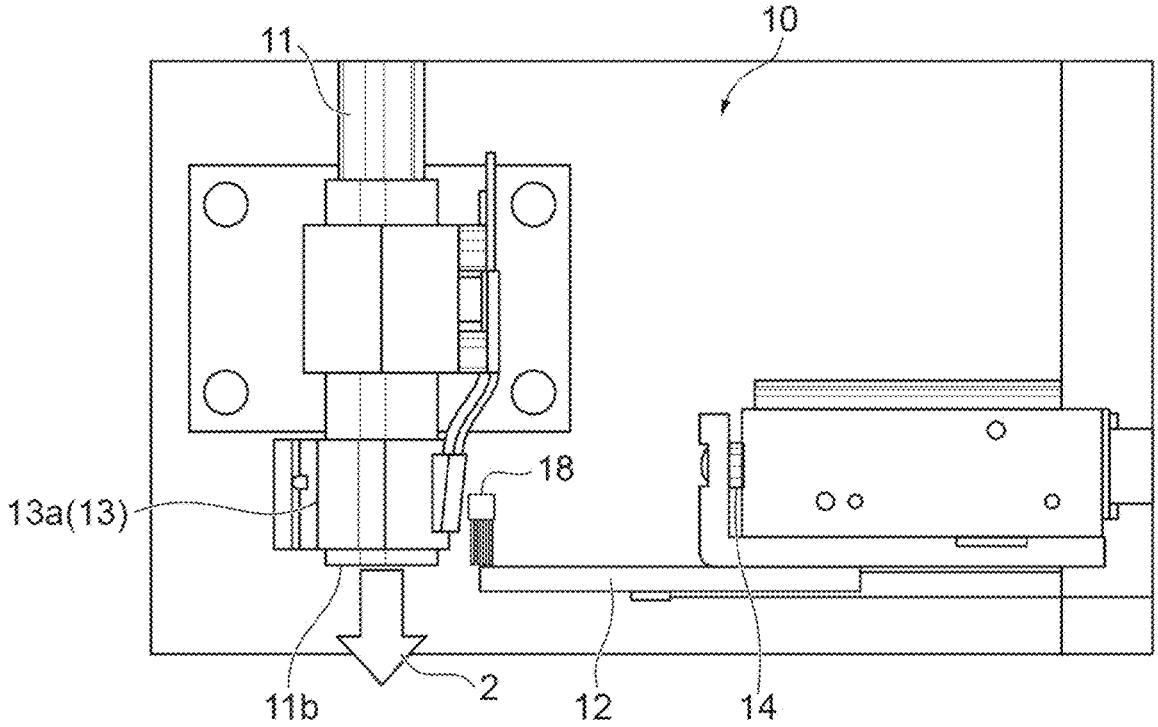

In FIGS. 4A and 4B, a cylinder 14 that drives the shutter 12 is connected to the shutter 12. As illustrated in FIG. 4A, when a rod of the cylinder 14 stretches, the shutter 12 is disposed at the closed position, and the discharge port 11*b* is closed. On the other hand, as illustrated in FIG. 4B, when the rod of the cylinder 14 contracts, the shutter 12 is disposed at the open position, and the discharge port 11*b* is opened. When the discharge port 11*b* is opened, the foundry sand 2 accommodated in the container 11 is discharged from the discharge port 11*b*. An operation of the cylinder 14 is controlled by a control device 60 to be described later.

The heating device 13 heats the foundry sand 2 accommodated in the container 11. As illustrated in FIG. 3, the heating device 13 includes a first heater 13*a* and a second heater 13*b*. The first heater 13*a* is, for example, a pipe heater, a nozzle heater, or a band heater, and is attached to the container 11 so as to surround the outer periphery of the container 11. The second heater is, for example, a planar heater such as a rubber heater and a plate heater, and is attached to a lower surface of the shutter 12.

The first heater 13*a* and the second heater 13*b* receive power from a power source (not illustrated) and generate heat. Due to the heat generated by the first heater 13*a* and the second heater 13*b*, the foundry sand 2 in the container 11 is heated, and the moisture contained in the foundry sand 2 evaporates. The evaporating moisture is released to the outside of the container 11 from a gap formed in the container 11 or from the supply port 11*a*. As the moisture in the foundry sand 2 evaporates, the foundry sand 2 is dried. Note that the measuring device 1 may include only one of the first heater 13*a* and the second heater 13*b* as the heating device 13.

As illustrated in FIG. 3, the first heater 13*a* may be covered with a heat insulating member 16 from outside. As the heat insulating member 16, a heat insulating member having heat resistance, such as a ceramic heat insulating tape or muffler Thermo Vantage, is used. When the first heater 13*a* is covered with the heat insulating member 16, a heat loss from the first heater 13*a* is reduced.

The supply device 10 may include a temperature sensor 17 configured to acquire a temperature of the foundry sand 2 accommodated in the container 11. For example, the temperature sensor 17 is attached to the container 11 and acquires a measured temperature of the container 11 as the temperature of the foundry sand 2. Although the temperature sensor 17 is provided on an outer surface of the container 11 in FIG. 3, the temperature sensor 17 may be provided inside the container 11, measure an internal temperature of the container 11, and acquire the internal temperature of the container 11 as the temperature of the foundry sand 2. In addition, the temperature sensor 17 may be a thermocouple that directly measures the temperature of the foundry sand 2 in contact with the foundry sand 2 inside the container 11. Operations of the first heater 13*a* and the second heater 13*b* are controlled by the control device 60 in accordance with the temperature of the foundry sand 2 acquired by the temperature sensor 17 such that the moisture in the foundry sand 2 evaporates.

As illustrated in FIG. 3, the supply device 10 may further include a chute 15. The chute 15 guides the foundry sand 2 discharged from the discharge port 11*b* to a discharge position P1. The discharge position P1 is located below the container 11 and is a position where the foundry sand 2 is received by a sample tray 3. The sample tray 3 is a heat-resistant tray on which the foundry sand 2 is placed. The sample tray 3 is, for example, a shallow ceramic tray. The chute 15 may be provided below the container 11 and have a tapered shape that narrows toward the discharge position P1. The chute 15 guides the foundry sand 2 discharged from the discharge port 11*b* to the discharge position P1, thereby suppressing scattering of the foundry sand 2. A lower end of the chute 15 may be disposed at a position close to the sample tray 3 disposed at the discharge position P1 in order to further suppress the scattering of the foundry sand 2.

The supply device 10 may further include a cleaning device 18 that cleans the shutter 12. The cleaning device 18 is, for example, a brush or spatula for cleaning. The cleaning device 18 is fixed to the housing 4, for example, and sweeps an upper surface of the shutter 12 when the shutter 12 moves between the closed position and the open position, thereby removing the foundry sand 2 adhering to the shutter 12. The cleaning by the shutter 12 prevents the foundry sand 2 adhering to the shutter 12 from during an LOI test of the previous cycle from being mixed into the foundry sand 2 introduced into the container 11 for an LOI test of the next cycle. Therefore, the accuracy of a quality evaluation of the foundry sand 2 can be improved. Note that the cleaning device 18 is not necessarily the brush or the spatula as long as the shutter 12 can be cleaned. For example, the cleaning device 18 may be a blower that sprays air to remove the foundry sand 2 on the shutter 12, a suction device that sucks and removes the foundry sand 2 on the shutter 12, or a vibration device that applies vibration to the shutter 12 to remove the foundry sand 2.

As illustrated in FIG. 2, the support 20 includes a shaft 21 and a measurement stage 22. The shaft 21 is erected in the Z direction in the housing 4, and supports the measurement stage 22 at an upper end thereof. A lower end of the shaft 21 is connected to the balance 30. The measurement stage 22 is a base on which the sample tray 3 is placed. The measurement stage 22 provides a measurement position P2 for measurement of the weight of the foundry sand 2.

The balance 30 is a highly accurate electronic balance, and measures the weight of the foundry sand 2 disposed on the measurement stage 22, that is, at the measurement position P2. Note that the housing 4 may be provided with a partition wall 6 that partitions an internal space of the housing 4 into an upper space for housing the furnace 40 and a lower space for housing the balance 30. The partition wall 6 is formed with a through-hole that allows the upper space and the lower space to communicate with each other. The shaft 21 of the support 20 extends from the lower space to the upper space through the through-hole of the partition wall 6, and the measurement stage 22 is disposed in the upper space. Since the lower space and the upper space are partitioned by the partition wall 6, the balance 30 is protected from the heat of the furnace 40. As a result, it is possible to suppress a decrease in measurement accuracy of the balance 30 due to the heat.

The furnace 40 heats the foundry sand 2. For example, the furnace 40 is an electric furnace calcining the foundry sand 2 at a set temperature. The term "calcining" means heating the foundry sand 2 at a temperature at which the binder contained in the foundry sand 2 vaporizes without melting the sand that is the main component of the foundry sand 2. For example, when the foundry sand 2 contains an alkali phenol resin as the binder, the set temperature for calcining the foundry sand 2 is set to 700° C. to 1000° C.

Note that the furnace 40 may include a temperature sensor that detects a temperature in the furnace 40. A temperature of the furnace 40 is controlled by the control device 60 in accordance with the temperature detected by the temperature sensor. As illustrated in FIG. 2, the furnace 40 has an opening through which the foundry sand 2 is accommodated in the furnace 40. In FIG. 2, the furnace 40 has a downward opening. The opening of the furnace 40 functions as an inlet/outlet for taking in and out the sample tray 3 disposed at the measurement position P2.

The conveying device 50 is a device that conveys the foundry sand 2 supplied from the supply device 10 from the discharge position P1 to the measurement position P2. As illustrated in FIG. 2, the conveying device 50 includes a movable frame 51 and an elevating device 52. The movable frame 51 is, for example, a slide rail including an outer rail 51*a* and an inner rail 51*b* slidable with respect to the outer rail 51*a*, and has a function of moving the foundry sand 2 in the X direction. The outer rail 51*a* is connected to the elevating device 52. The inner rail 51*b* is detachably connected to a pull-out portion 54 via an engagement portion 53.

As illustrated in FIG. 1, the pull-out portion 54 includes a handle 54*a*. When the handle 54*a* is gripped and the pull-out portion 54 is taken in and out in the X direction in a state where the movable frame 51 and the pull-out portion 54 are connected by the engagement portion 53, the inner rail 51*b* of the movable frame 51 slides with respect to the outer rail 51*a*.

As illustrated in FIG. 1, the inner rail 51*b* supports a support base 55. The support base 55 has an opening 55*a*. A diameter of the opening 55*a* is larger than a diameter of the measurement stage 22 of the support 20 and smaller than a diameter of the sample tray 3. During the LOI test, the sample tray 3 is fitted and held in the opening 55*a* of the support base 55.

As illustrated in FIG. 2, the elevating device 52 includes an actuator 56 and a connecting frame 57, and has a function of moving the foundry sand 2 and the furnace 40 in the Z direction. The actuator 56 is, for example, a hydraulic cylinder, an air cylinder, or an electric cylinder, and moves the connecting frame 57 in the Z direction. The connecting frame 57 is connected to the furnace 40 and the movable frame 51. When the connecting frame 57 moves in the Z direction by driving of the actuator 56, the furnace 40 and the movable frame 51 move in the Z direction along with the movement of the connecting frame 57.

In one embodiment, the measuring device 1 further includes the control device 60. The control device 60 is a computer including a processor, a storage unit, an input device, a display device, and the like, and controls the entire operation of the measuring device 1. The storage unit of the control device 60 stores a control program for causing the processor to control various processes executed by the control device 60. The control device 60 is communicably connected to the supply device 10, the balance 30, the furnace 40, and the conveying device 50, and acquires, for example, information indicating the internal temperature of the container 11 detected by the temperature sensor 17 and information indicating the weight of the foundry sand 2 measured by the balance 30. In addition, the control device 60 sends a control signal to the heating device 13, the cylinder 14, the furnace 40, and the elevating device 52 to control operations of these devices. Further, the control device 60 measures the LOI of the foundry sand 2 on the basis of the weights of the foundry sand 2 before and after calcination. Although FIG. 2 illustrates the control device 60 disposed outside the housing 4, the control device 60 may be disposed inside the housing 4.

The control device 60 may be configured to enable an operator to perform a command input operation and the like in order to control the measuring device 1 using the input device. For example, as illustrated in FIG. 1, the control device 60 includes a touch panel display 62 functioning as the input device and the display device, and the touch panel display 62 can be operated to instruct the measuring device 1 to start processing such as removal of moisture from the foundry sand 2, discharge of the foundry sand 2, and LOI measurement.

For example, when an instruction to remove moisture from the foundry sand 2 is received from the operator, the control device 60 heats the foundry sand 2 in the container 11 by the heating device 13. At this time, the control device 60 controls the operation of the heating device 13 in accordance with the temperature of the temperature sensor 17 to adjust the internal temperature of the container 11 such that the moisture in the foundry sand 2 sufficiently evaporates. For example, the control device 60 controls the heating device 13 such that the foundry sand 2 in the container 11 is heated at 140° C. for 5 minutes. Note that the measuring device 1 may operate the heating device 13 when the measuring device 1 is activated or when the instruction for the moisture removal is received for the first time, and thereafter control the heating device 13 such that the inside of the container 11 has a constant temperature.

When an instruction to discharge the foundry sand 2 is received from the operator, the control device 60 controls the cylinder 14 to move the shutter 12 from the closed position to the open position. When the shutter 12 is disposed at the open position, the foundry sand 2 is discharged from the discharge port 11*b* of the container 11. The foundry sand 2 discharged from the container 11 is supplied to the sample tray 3 disposed at the discharge position P1.

When an instruction to measure the LOI is received from the operator, the control device 60 moves the furnace 40 downward using the elevating device 52, and accommodates the foundry sand 2 disposed at the measurement position P2 in the furnace 40. Next, the foundry sand 2 is calcined in the furnace 40, and the weights of the foundry sand 2 before and after the calcination are acquired. Then, the control device 60 measures the LOI of the foundry sand 2 on the basis of the weights of the foundry sand 2 before and after calcination, and displays the measured LOI on the touch panel display 62. Note that the measuring device 1 may heat the furnace 40 when the measuring device 1 is activated or when an instruction for heating is received for the first time.

Figure 5:
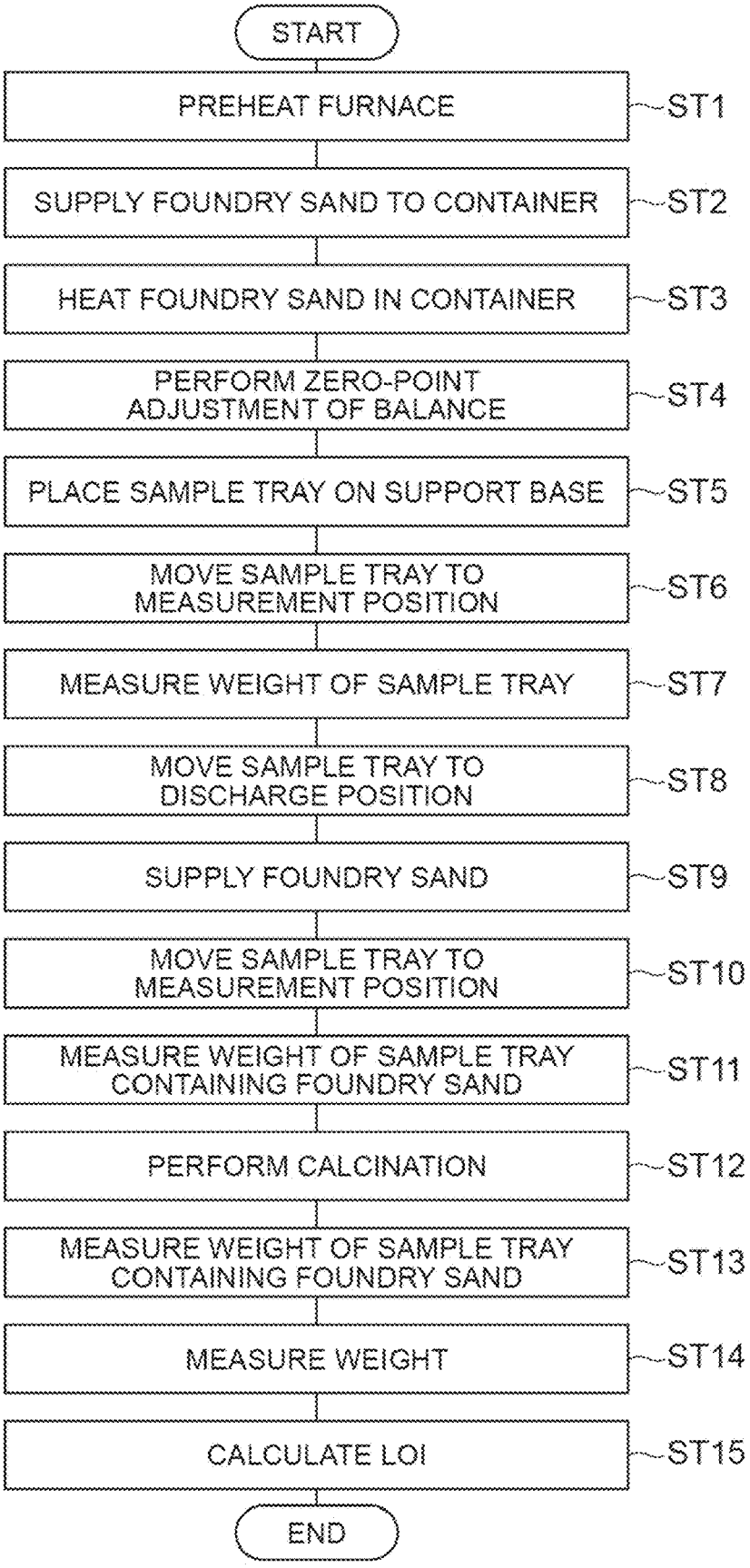
FIG. 5 is a flowchart illustrating an operation of the measuring device.

Next, an operation of the measuring device 1 will be described in more detail with reference to FIGS. 5 to 8B. FIG. 5 is a flowchart illustrating a method for measuring the LOI of the foundry sand 2 using the measuring device 1.

In this method, first, the furnace 40 is preheated to a set temperature (step ST1). The set temperature can be set by the operator. For example, the control device 60 performs heating such that the temperature in the furnace 40 to be a temperature at which the binder in the foundry sand 2 vaporizes, for example, 1000° C. Note that the control device 60 may display information indicating that the preheating of the furnace 40 is completed on the touch panel display 62 when the temperature in the furnace 40 rises to the set temperature. In addition, the control device 60 controls the elevating device 52 to move the furnace 40 and the movable frame 51 downward. As the furnace 40 moves downward, the measurement stage 22 of the support 20 is accommodated in the furnace 40.

Next, the foundry sand 2 to be subjected to the LOI measurement is supplied from the supply port 11*a* into the container 11 (step ST2). Next, the heating device 13 is operated to heat the foundry sand 2 in the container 11 (step ST3). For example, the control device 60 operates the first heater 13*a* and the second heater 13*b* to raise the temperature of the container 11 to 140° C., and heats the foundry sand 2 in the container 11 for 5 minutes to remove moisture of the foundry sand 2. The control device 60 may simultaneously perform the preheating of the furnace 40 and the moisture removal from the foundry sand 2.

Next, zero-point adjustment of the balance 30 is performed (step ST4). At this time, nothing is placed on the measurement stage 22 of the support 20, and thus, the weight measured by the balance 30 should be zero. If the measured weight is not zero, the balance 30 sets the weight at this time to zero. After the zero-point adjustment of the balance 30, the furnace 40 is moved upward by the elevating device 52.

Figure 6B:
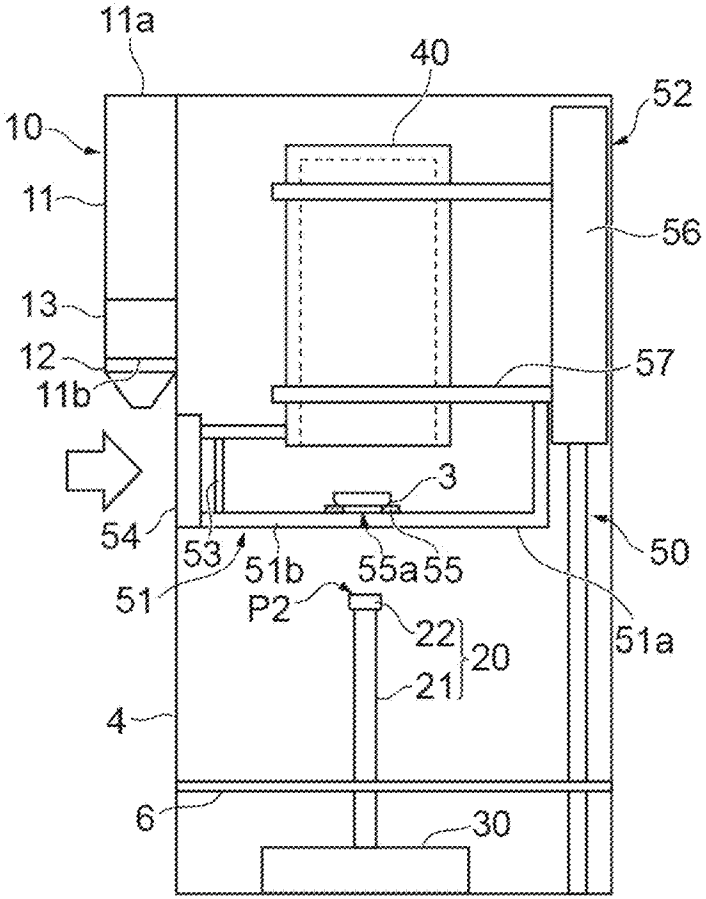
FIGS. 6A and 6B are diagrams illustrating the operation of the measuring device.
Figure 6A:
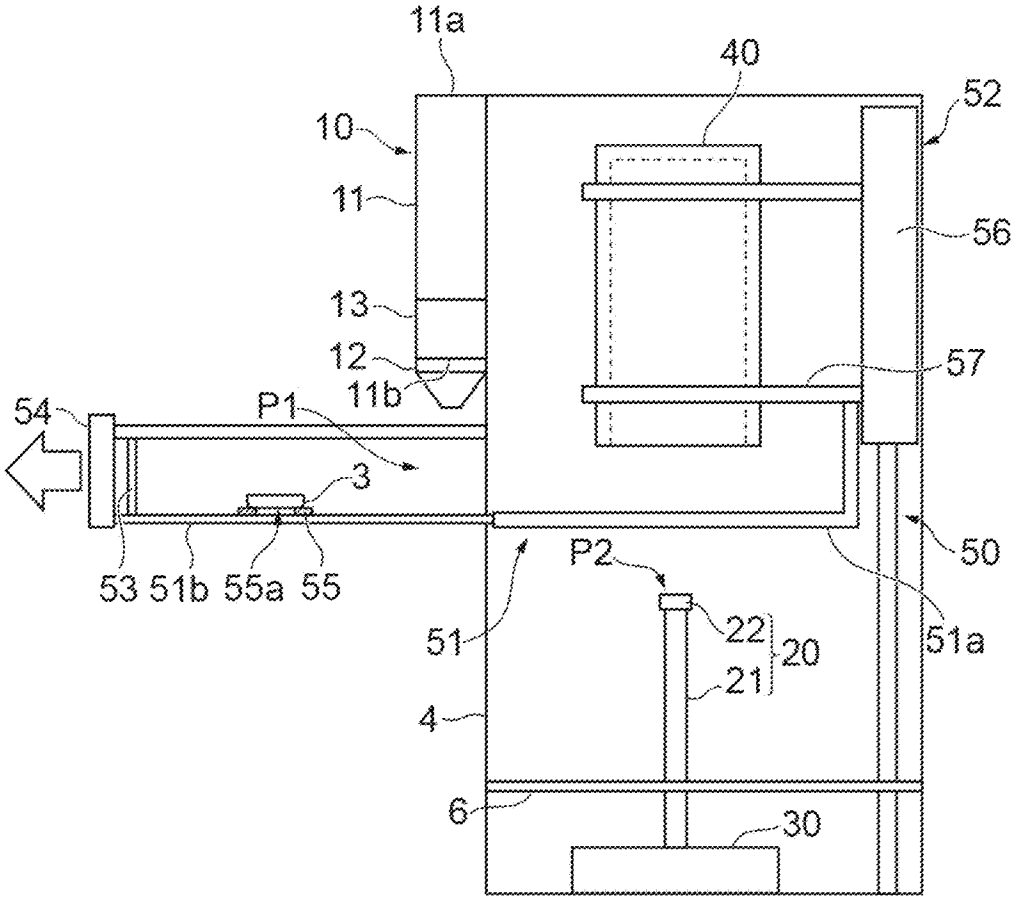

Next, the sample tray 3 is placed on the support base 55 (step ST5). Specifically, as illustrated in FIG. 6A, the operator slides the pull-out portion 54 toward the front side to place the sample tray 3 on the opening 55*a* of the support base 55 pulled out from the housing 4.

Next, the conveying device 50 moves the sample tray 3 set on the support base 55 to the measurement position P2 (step ST6). For example, as illustrated in FIG. 6B, the operator pushes the pull-out portion 54 into the housing 4 to slide the inner rail 51*b* toward the back side and dispose the sample tray 3 above the measurement stage 22. Then, the control device 60 controls the elevating device 52 to move the furnace 40 and the movable frame 51 downward. When the movable frame 51 moves downward, as illustrated in FIG. 7A, the measurement stage 22 of the support 20 passes through the opening 55*a* of the support base 55, and the sample tray 3 on the support 20 is transferred to the measurement stage 22.

On the other hand, the movable frame 51 descends to a position below the measurement stage 22. As the furnace 40 moves downward together with the movable frame 51, the sample tray 3 is accommodated in the furnace 40. When a predetermined time passes after the sample tray 3 is accommodated in the furnace 40, the weight of the sample tray 3 is measured by the balance 30 (step ST7). The weight measured in step ST7 is the weight of the empty sample tray 3. Information indicating the measured weight of the sample tray 3 is transmitted to the control device 60.

Next, the sample tray 3 is moved to the discharge position P1 (step ST8). Specifically, the control device 60 controls the elevating device 52 to move the furnace 40 and the movable frame 51 upward. When the movable frame 51 moves upward, the sample tray 3 placed on the measurement stage 22 is fitted into the opening 55*a* and lifted by the support base 55. As the furnace 40 moves upward together with the movable frame 51, the sample tray 3 is taken out of the furnace 40. Then, when the operator pulls out the pull-out portion 54 to the front side, the measurement stage 22 moves to the front side in the X direction, and the sample tray 3 is disposed at the discharge position P1. Note that the discharge position P1 is a position below the discharge port 11*b* of the container 11.

Figure 7B:
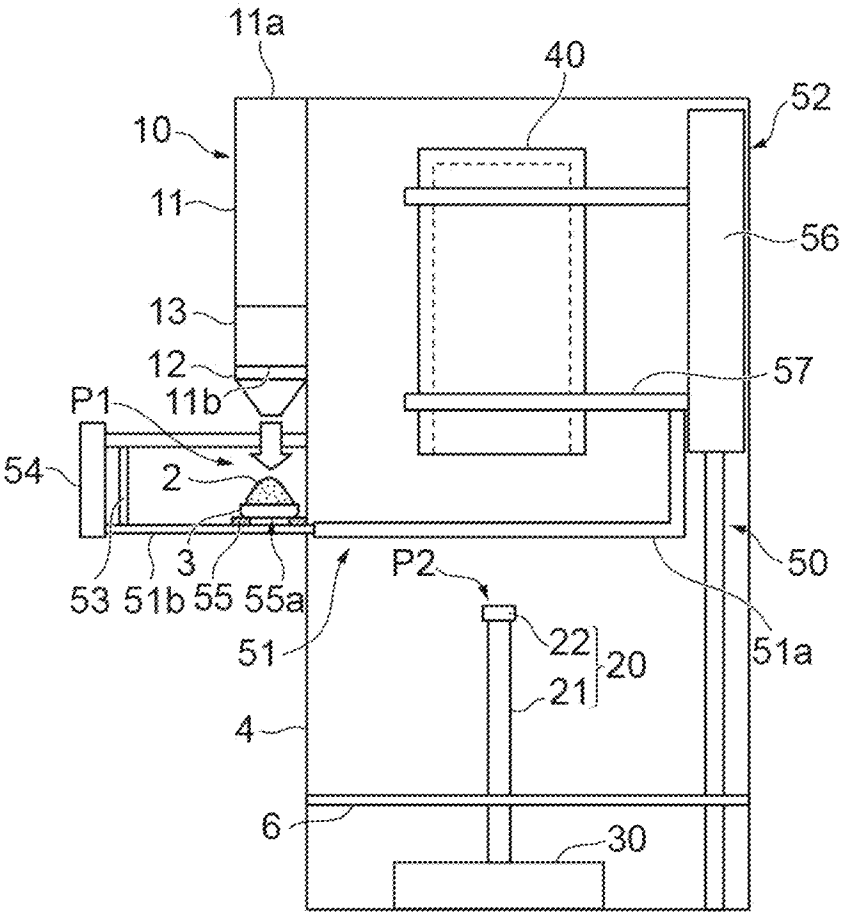
FIGS. 7A and 7B are diagrams illustrating the operation of the measuring device.
Figure 7A:
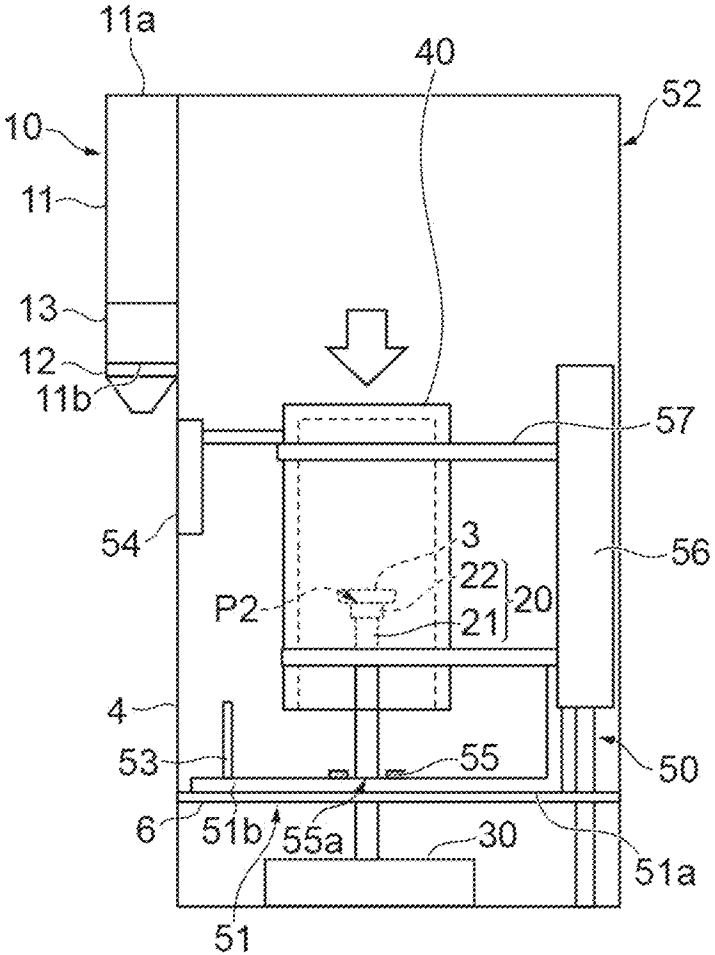

Next, as illustrated in FIG. 7B, the foundry sand 2 is discharged from the container 11 and supplied to the sample tray 3 (step ST9). Specifically, the control device 60 moves the shutter 12 to the open position to discharge the foundry sand 2 from the discharge port 11*b* toward the sample tray 3 along the chute 15. The foundry sand 2 supplied from the container 11 is heated by the heating device 13 to remove moisture.

Figure 8B:
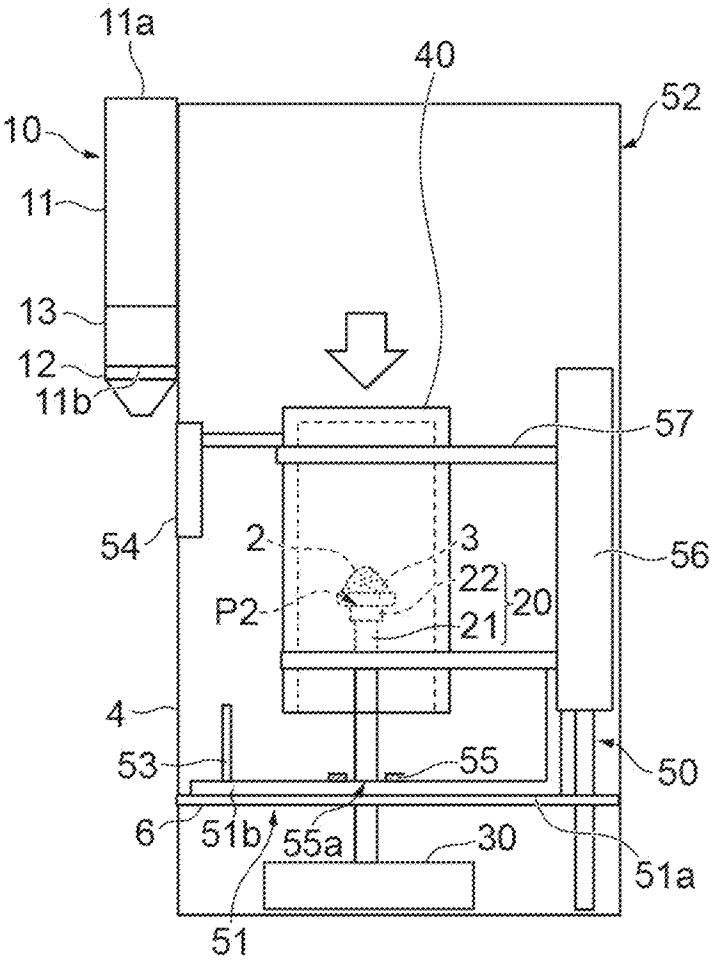
FIGS. 8A and 8B are diagrams illustrating the operation of the measuring device.
Figure 8A:
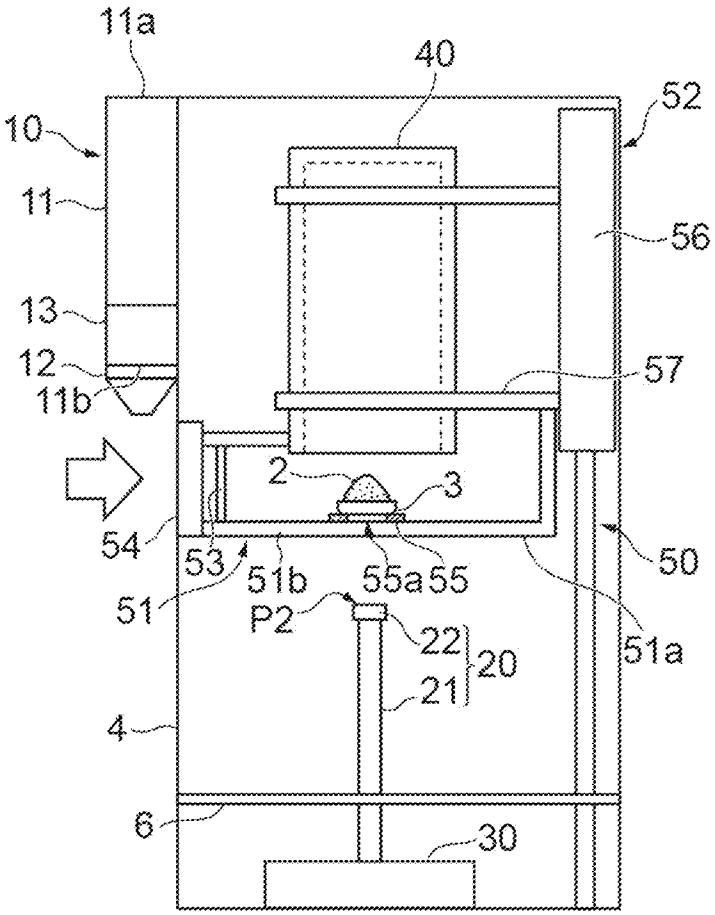

Next, the sample tray 3 containing the foundry sand 2 is moved from the discharge position P1 to the measurement position P2 (step ST10). Specifically, as illustrated in FIG. 8A, the operator pushes the pull-out portion 54 into the housing 4 to slide the support base 55 to the back side in the X direction and dispose the sample tray 3 above the measurement stage 22. Then, the control device 60 controls the elevating device 52 to move the furnace 40 and the movable frame 51 downward. When the movable frame 51 moves downward, as illustrated in FIG. 8B, the measurement stage 22 of the support 20 passes through the opening 55*a* of the support base 55, and the sample tray 3 on the support base 55 is transferred to the measurement stage 22. On the other hand, the movable frame 51 descends to a position below the measurement stage 22. As the furnace 40 moves downward together with the movable frame 51, the sample tray 3 is accommodated in the furnace 40.

When a predetermined time passes after the sample tray 3 containing the foundry sand 2 is accommodated in the furnace 40, the weight of the sample tray 3 containing the foundry sand 2 is measured by the balance 30 (step ST11). The weight measured in step ST11 is the weight of the sample tray 3 containing the foundry sand 2 before calcination. Information indicating the measured weight is transmitted to the control device 60.

Next, the sample tray 3 containing the foundry sand 2 is calcined in the furnace 40 (step ST12). When the foundry sand 2 is calcined in the furnace 40, the binder in the foundry sand 2 vaporizes. After the foundry sand 2 is calcined for a set time, the weight of the sample tray 3 containing the foundry sand 2 is measured again by the balance 30 (step ST13). The weight measured in step ST13 is the weight of the sample tray 3 containing the foundry sand 2 after calcination. Information indicating the measured weight is transmitted to the control device 60.

Next, the furnace 40 and the movable frame 51 are moved upward by the elevating device 52. Then, when the operator pulls out the pull-out portion 54 to the front side, the sample tray 3 is taken out from the housing 4. Next, the pull-out portion 54 is pushed into the housing 4 again, and the furnace 40 is moved downward by the elevating device 52. As a result, the measurement stage 22 of the support 20 is accommodated in the furnace 40. Next, the weight is measured by the balance 30 in a state where nothing is placed on the measurement stage 22 (step ST14). Information indicating the measured weight is transmitted to the control device 60.

Next, the LOI of the foundry sand 2 is measured by the control device 60 (step ST15). The LOI of the foundry sand 2 is obtained by, for example, the following Formula (1).

$$\text{LOI}(\%)=\{(\text{Weight measured in step ST11}-\text{Weight measured in step ST13}-\text{Weight measured in step ST14})/(\text{Weight measured in step ST11}-\text{Weight measured in step ST7})\}\times 100 \quad (1)$$

The control device 60 displays the measured LOI on the touch panel display 62. Note that the control device 60 may store the LOI in a storage device or may transmit the LOI to an external device.

In a case where an LOI of the other foundry sand is measured, the other foundry sand is supplied to the sample tray 3, and the processes of steps ST1 to ST15 are performed again.

As described above, the measuring device 1 includes the heating device 13 that heats the foundry sand 2 in the container 11, and thus, the foundry sand 2 from which moisture has been removed is discharged from the container 11. Then, the LOI of the foundry sand 2 can be measured by conveying the foundry sand 2 from the discharge position P1 to the measurement position P2 and measuring the weight of the foundry sand 2 by the balance 30 while heating the foundry sand 2 in the furnace 40. Since the measuring device 1 can measure the LOI of the foundry sand 2 from which moisture has been removed, the amount of the binder in the foundry sand 2 can be accurately measured. Therefore, the quality of the foundry sand 2 can be evaluated with high accuracy.

When the time for the moisture removal from the foundry sand 2 is added, the time taken to obtain a measurement result of the LOI is prolonged, and it becomes difficult to evaluate the quality of the foundry sand 2 in real time. However, the measuring device 1 can simultaneously perform the heating of the furnace 40 and the moisture removal from the foundry sand 2 by the heating device 13, and thus, it is possible to suppress the prolongation of the LOI measurement time. As a result, the quality of the foundry sand can be evaluated in real time.

Figure 9:
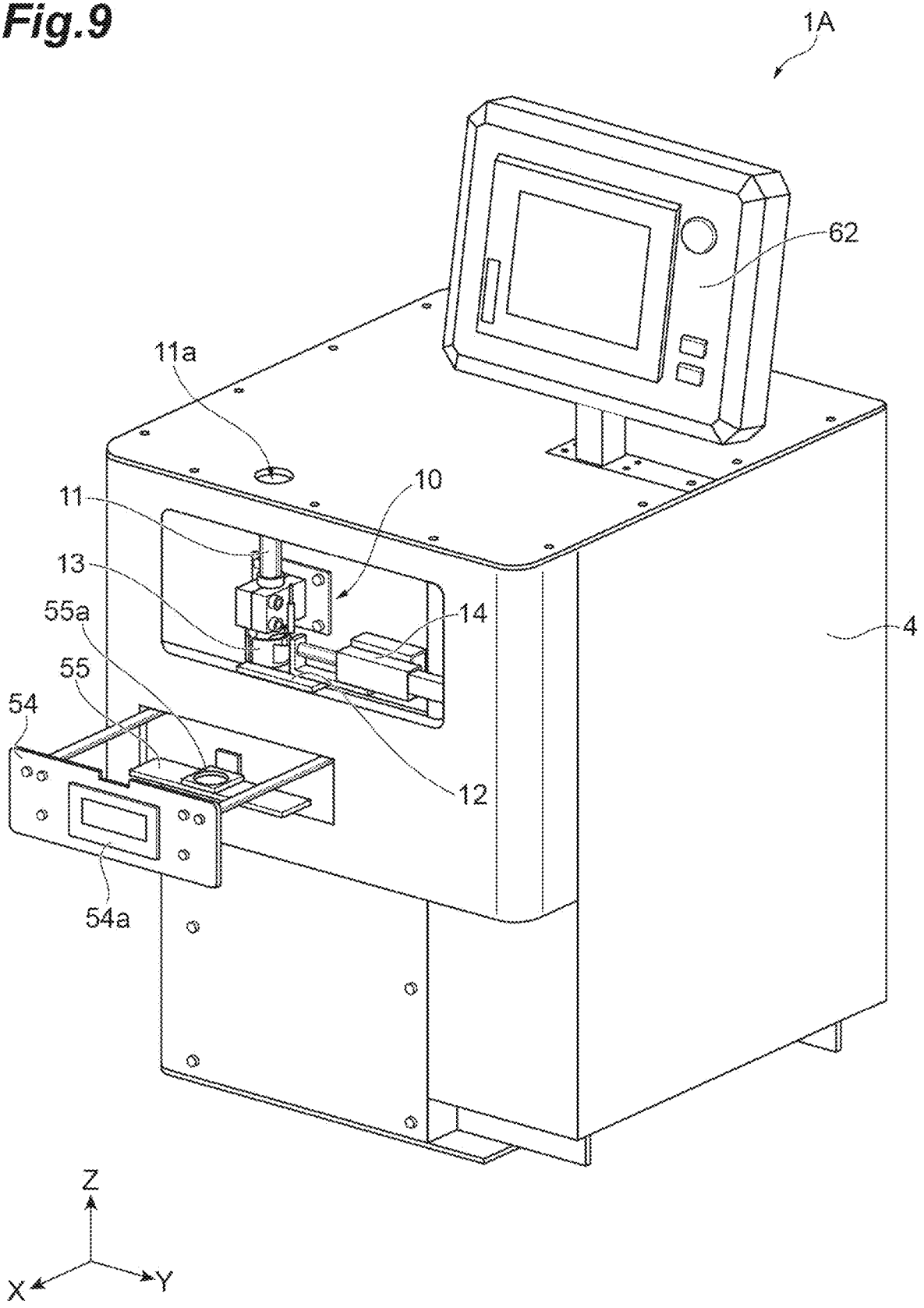
FIG. 9 is a perspective view illustrating an appearance of a measuring device according to another embodiment.
Figure 10:
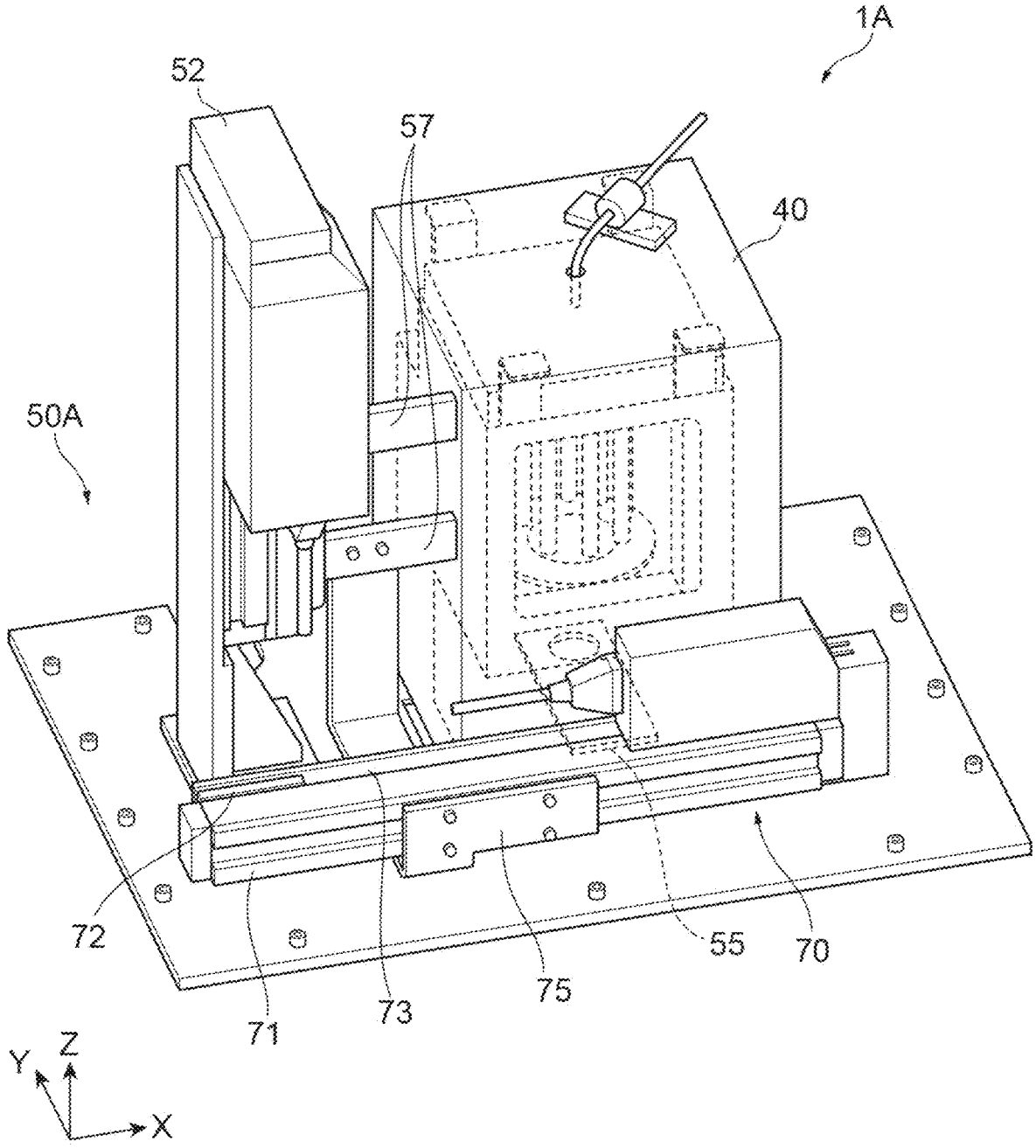
FIG. 10 is a perspective view illustrating an exemplary internal configuration of the measuring device.

Next, a measuring device according to another embodiment will be described. FIG. 9 is a perspective view illustrating an appearance of a measuring device 1A according to another embodiment. FIG. 10 is a perspective view illustrating an exemplary internal configuration of the measuring device 1A. In the following description, differences from the measuring device 1 described above will be mainly described, and redundant description will be omitted.

As shown in FIG. 10, the measuring device 1A includes a conveying device 50A instead of the conveying device 50. The conveying device 50A includes a cylinder device 70 in addition to the elevating device 52 described above. The cylinder device 70 is, for example, a hydraulic cylinder, an air cylinder, or an electric cylinder, and moves the foundry sand 2 supplied from the supply device 10 in the X direction (horizontal direction).

In one embodiment, as shown in FIG. 10, the cylinder device 70 includes a main body 71 and a slider 72. The main body 71 extends in the X direction. The slider 72 is slidable with respect to the main body 71 to the front side or the back side along the X direction by a driving force from a driving source (not shown). The operation of the slider 72 is controlled by the controller 60.

A slide plate 73 is connected to the slider 72. The slide plate 73 is, for example, a metal plate, and moves in the X direction together with the slider 72. The slide plate 73 supports the support base 55. Therefore, along with the movement of the slider 72 in the X direction, the support base 55 and the sample tray 3 placed thereon or the sample tray 3 containing the molding sand 2 are moved in the X direction.

The measuring device 1A further includes a bracket 75. The main body 71 of the cylinder device 70 is coupled to the connecting frame 57 of the elevating device 52 via a bracket 75. When the connecting frame 57 is moved in the Z direction by the driving of the elevating device 52, the cylinder device 70 is moved in the Z direction together with the connecting frame 57. The support base 55 and the sample tray 3 placed thereon or the sample tray 3 containing the foundry sand 2 are moved in the Z direction along with the movement of the cylinder device 70 in the Z direction. As described above, the position of the support base 55 in the X direction and the Z direction is adjusted by the operations of the elevating device 52 and the cylinder device 70.

The operation of the measuring device 1A will be described with reference to FIGS. 11A, 11B, 12A and 12B. The conveying device 50A of the measuring device 1A has a function of moving the support base 55 between the discharge position P1 and the measurement position P2.

Figure 11B:
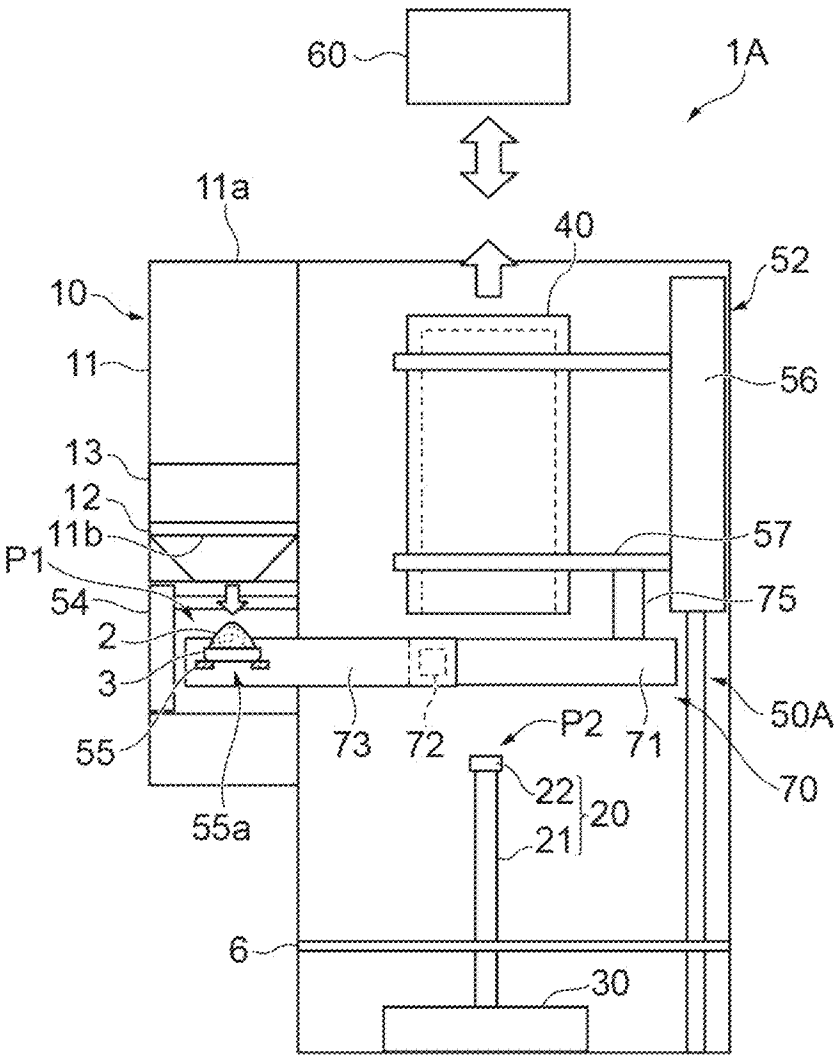
FIGS. 11A and 11B are a diagram illustrating an operation of the measuring device.
Figure 11A:
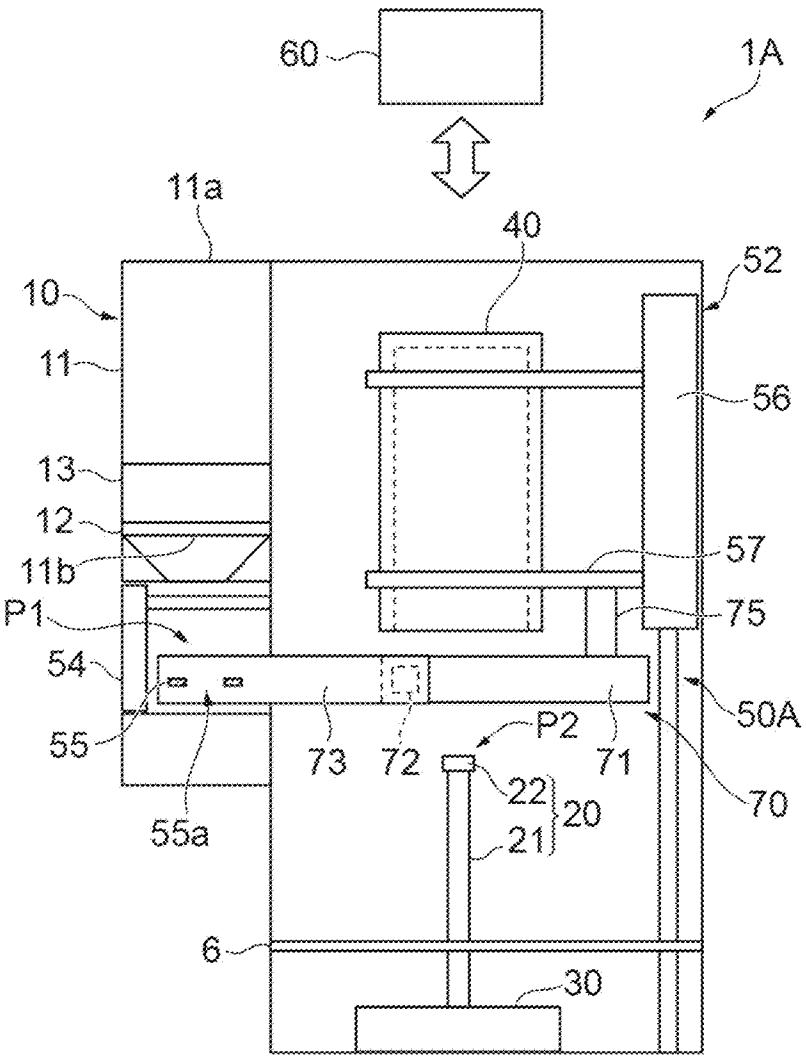

For example, when a predetermined operation is performed, the control device 60 controls the cylinder device 70 to slide the slider 72 in the X direction and move the slide plate 73 to the front side. Accordingly, as shown in FIG. 11A, the support base 55 is moved to the front side in the X direction together with the slide plate 73, and is disposed at the discharge position P1. When the support base 55 is disposed at the discharge position P1, a message prompting the user to open (draw out) the pull-out portion 54 and set the sample tray 3 is displayed on the touch panel display 62. When the pull-out portion 54 is opened before the support base 55 is disposed at the discharge position P1, the operations of all the actuators of the measuring device 1A or all the actuators except for the shutter 12 may be stopped. The opening and closing of the pull-out portion 54 can be detected by, for example, a magnet switch.

Next, the pull-out portion 54 is opened by the operator, and the sample tray 3 is placed on the support base 55 disposed at the discharge position P1. Thereafter, when the pull-out portion 54 is closed and an operation for discharging the foundry sand 2 is performed, as shown in FIG. 11B, the control device 60 controls the elevating device 52 to move the connecting frame 57 upward. Thus, the cylinder device 70 coupled to the connecting frame 57 via the bracket 75 moves upward together with the connecting frame 57. Thereafter, the foundry sand 2 is discharged from the discharge port 11*b* of the container 11, and the foundry sand 2 is supplied to the sample tray 3. At this time, the cylinder device 70 is moved upward, whereby the sample tray 3 on the support base 55 is brought close to the discharge port 11*b* of the container 11, so that the scattering of the foundry sand 2 at the time of discharge is further suppressed.

Figure 12B:
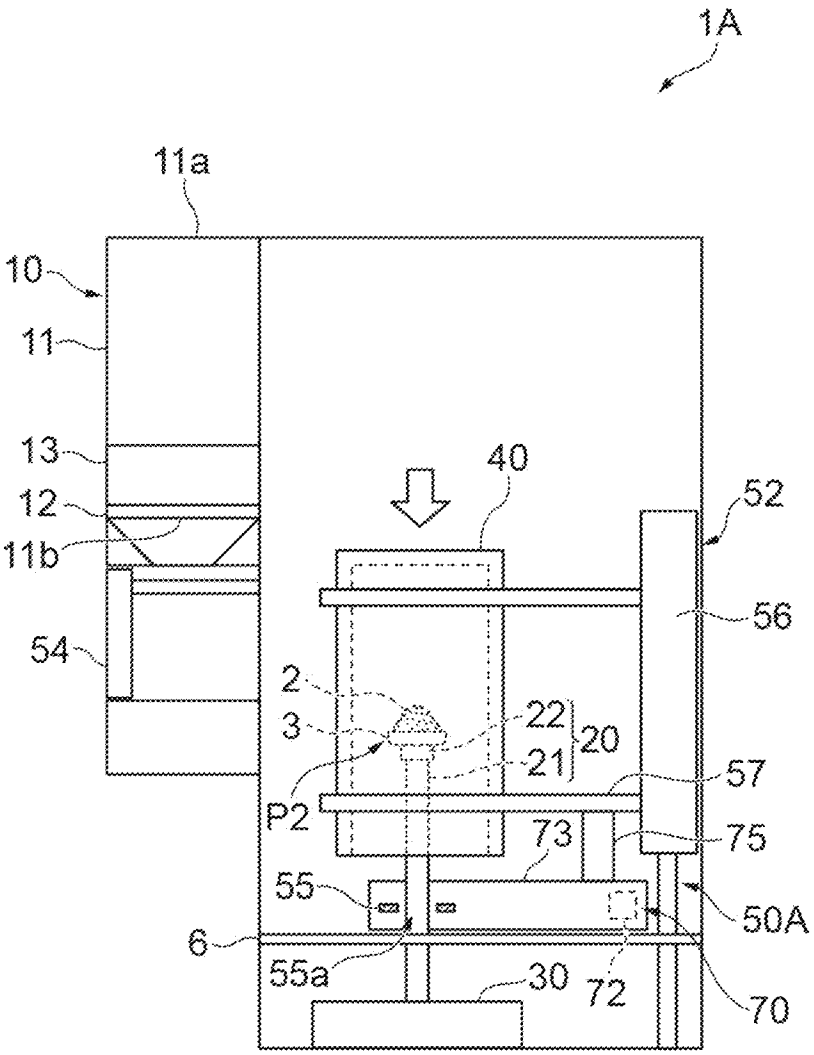
FIGS. 12A and 12B are a diagram illustrating an operation of the measuring device.
Figure 12A:
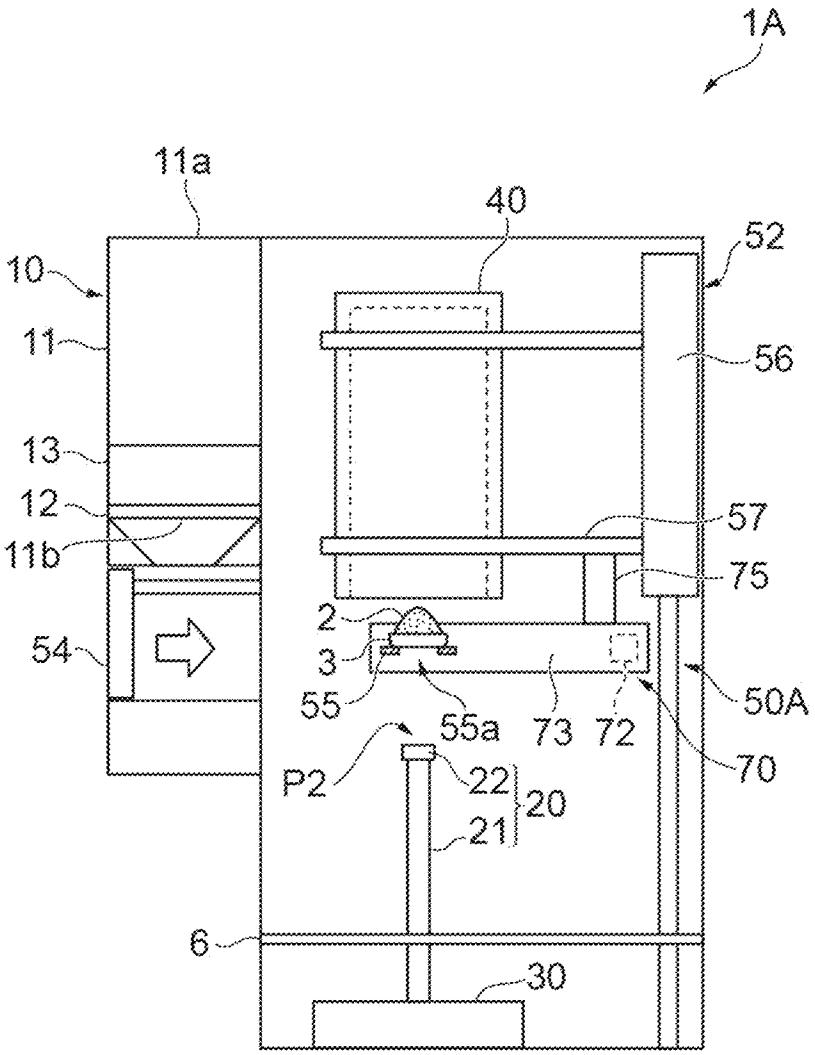

Next, the control device 60 controls the cylinder device 70 to slide the slider 72 and move the slide plate 73 to the back side. As a result, as shown in FIG. 12A, the support base 55 is moved to the back side together with the slide plate 73, and the sample tray 3 is disposed above the measurement stage 22. Next, the control device 60 controls the elevating device 52 to move the connecting frame 57 downward. As a result, as shown in FIG. 12B, the support base 55 moves downward together with the cylinder device 70, and the sample tray 3 on the support base 55 is transferred onto the measurement stage 22. As described above, the sample tray 3 containing the foundry sand 2 is moved from the discharge position P1 to the measurement position P2. The conveying device 50A can also move the sample tray 3 containing the foundry sand 2 from the measurement position P2 to the discharge position P1 in a procedure opposite to the above-described procedure.

As described above, in the measuring device 1A, the position of the support base 55 in the X direction and the Z direction is controlled in response to the operations of the elevating device 52 and the cylinder device 70. Therefore, the LOI of the foundry sand 2 can be automatically measured by controlling the position of the support base 55 after the foundry sand 2 is charged into the sample tray 3. In addition, by using the elevating device 52 and the cylinder device 70, it is possible to adjust the position of the support base 55 with high accuracy compared to a case where the position of the support base 55 is adjusted by manually taking in and out the pull-out portion 54. Therefore, the sample tray 3 or the sample tray 3 containing the foundry sand 2 can be disposed at the discharge position P1 and the measurement position P2 with high accuracy.

Although the measuring devices 1 and 1A according to various embodiments have been described above, the present invention is not limited to the above embodiments, and various modifications can be made without changing the gist of the invention. That is, it should be noted that the above embodiments are intended for the purpose of illustration and are not intended to limit the scope of the present invention.

For example, the foundry sand 2 on the sample tray 3 is conveyed from the discharge position P1 to the measurement position P2 using the movable frame 51 and the elevating device 52 in the measuring device 1, but a device that conveys the foundry sand 2 is not limited to the movable frame 51 and the elevating device 52. For example, a robot arm or the like may be used to convey the foundry sand 2 from the discharge position P1 to the measurement position P2.

In addition, the supply device 10 may include a lid that can be manually opened and closed, instead of the shutter 12. The above various embodiments can be combined within a range having no contradiction.

The present disclosure includes the following contents.

[Clause 1] A measuring device according to one aspect is used to measure a loss on ignition of foundry sand. This measuring device includes: a container configured to accommodate foundry sand, the container having a discharge port for discharging the foundry sand to a discharge position; a heating device configured to heat the foundry sand in the container; a conveying device configured to convey the foundry sand discharged from the discharge port from the discharge position to a measurement position; a balance configured to measure the weight of the foundry sand disposed at the measurement position; and a furnace configured to heat the foundry sand.

Since the above-described measuring device includes the heating device that heats the foundry sand in the container, the foundry sand from which moisture has been removed is discharged from the container. Then, the loss on ignition of the foundry sand can be measured by conveying the foundry sand from the discharge position to the measurement position and measuring the weight of the foundry sand by the balance while heating the foundry sand in the furnace. In this measuring device, the loss on ignition of the foundry sand from which moisture has been removed can be obtained, and thus, the amount of the binder in the foundry sand can be accurately measured. Therefore, the quality of the foundry sand can be evaluated with high accuracy. In addition, this measuring device can simultaneously perform the heating of the furnace and the moisture removal from the foundry sand, and thus, it is possible to suppress prolongation of the time for measuring the loss on ignition. As a result, the quality of the foundry sand can be evaluated in real time.

[Clause 2] The measuring device according to Clause 1 may further include a shutter movable between a closed position where the discharge port is closed and an open position where the discharge port is opened. In this mode, the foundry sand is discharged from the container when the shutter is disposed at the open position, and the discharge of the foundry sand from the container is stopped when the shutter is disposed at the closed position. Therefore, the supply of the foundry sand and the stop of the supply can be switched by providing the shutter.

[Clause 3] In the measuring device according to Clause 1 or 2, the heating device may include a first heater attached to the container. The moisture in the foundry sand can be efficiently removed by heating the foundry sand in the container with the first heater attached to the container.

[Clause 4] The measuring device according to Clause 3 may further include a heat insulating member that covers the first heater from outside. Since the first heater is covered with the heat insulating member from outside, a heat loss from the first heater can be reduced.

[Clause 5] In the measuring device according to any one of Clauses 1 to 4, the heating device may include a second heater attached to the shutter. The moisture in the foundry sand can be efficiently removed by heating the foundry sand in the container with the second heater attached to the shutter.

[Clause 6] The measuring device according to any one of Clauses 1 to 5 may further include a chute configured to guide the foundry sand discharged from the discharge port to the discharge position. The foundry sand is reliably guided from the discharge port to the discharge position by providing the chute, thereby suppressing scattering of the foundry sand.

[Clause 7] The measuring device according to any one of Clauses 1 to 6 may further include a temperature sensor configured to acquire a temperature of the foundry sand in the container, and a control device configured to control an operation of the heating device in response to the acquired temperature of the foundry sand. The moisture of the foundry sand in the container can be reliably removed by controlling the operation of the heating device in accordance with an internal temperature of the container.

[Clause 8] The measuring device according to any one of Clauses 1 to 7 may further include a cleaning device configured to clean the shutter in response to movement of the shutter between the closed position and the open position. If foundry sand that is not a test object for the loss on ignition adheres to the shutter, this foundry sand may be mixed into foundry sand that is the test object for the loss on ignition. When the shutter is cleaned using the cleaning device, the mixing of the foundry sand that is not the test object can be prevented, and deterioration of the quality evaluation of the foundry sand can be suppressed.

[Clause 9] In the measuring device according to any one of Clauses 1 to 8, the container may have a cylindrical shape. The foundry sand can be smoothly discharged from the discharge port without being left in the container.

[Clause 10] The measuring device according to any one of Clauses 1 to 9, wherein the conveying device includes a elevating device configured to move the foundry sand in a vertical direction, and a cylinder device configured to move the foundry sand in a horizontal direction.

[Clause 11] The measuring device according to Clause 10, wherein the cylinder device is coupled to the elevating device so as to be movable in the vertical direction in response to an operation of the elevating device.

REFERENCE SIGNS LIST

1, 1A Measuring device
2. Foundry sand
11 Container
11*b* Discharge port
12 Shutter
13 Heating device
13*a* First heater
13*b* Second heater
15 Chute
16 Heat insulating member
17 Temperature sensor
18 Cleaning device
30 Balance
40 Furnace
50, 50A Conveying device
60 Control device
P1 Discharge position
P2 Measurement position.

What is claimed is:

1. A measuring device for measuring a loss on ignition of foundry sand, the measuring device comprising:

a container configured to accommodate the foundry sand, the container having a discharge port for discharging the foundry sand to a discharge position;

a heating device configured to heat the foundry sand in the container;

a conveying device configured to convey the foundry sand discharged from the discharge port from the discharge position to a measurement position;

a balance configured to measure a weight of the foundry sand disposed at the measurement position; and a furnace configured to heat the foundry sand.

2. The measuring device according to claim 1, further comprising a shutter movable between a closed position where the discharge port is closed and an open position where the discharge port is opened.

3. The measuring device according to claim 2, wherein the heating device includes a second heater attached to the shutter.

4. The measuring device according to claim 2, further comprising a cleaning device configured to clean the shutter in response to movement of the shutter between the closed position and the open position.

5. The measuring device according to claim 1, wherein the heating device includes a first heater attached to the container.

6. The measuring device according to claim 5, further comprising a heat insulating member that covers the first heater from outside.

7. The measuring device according to claim 1, further comprising a chute configured to guide the foundry sand discharged from the discharge port to the discharge position.

8. The measuring device according to claim 1, further comprising:

a temperature sensor configured to acquire a temperature of the foundry sand in the container; and a control device configured to control an operation of the heating device in response to the acquired temperature of the foundry sand.

9. The measuring device according to claim 1, wherein the container has a cylindrical shape.

10. The measuring device according to claim 1, wherein the conveying device includes a elevating device configured to move the foundry sand in a vertical direction, and a cylinder device configured to move the foundry sand in a horizontal direction.

11. The measuring device according to claim 10, wherein the cylinder device is coupled to the elevating device so as to be movable in the vertical direction in response to an operation of the elevating device.

* * * * *